United States Patent [19]

Koponen et al.

[11] 4,056,433

[45] Nov. 1, 1977

[54] ASCENDING TWIN-WIRE PAPER MACHINE WITHOUT WEB PICK-UP

[75] Inventors: Martti Koponen; Pertti Soikkanen, both of Jyvaskyla, Finland

[73] Assignee: Valmet Oy, Finland

[21] Appl. No.: 723,224

[22] Filed: Sept. 15, 1976

[30] Foreign Application Priority Data

Sept. 16, 1975 Finland ..... 752585

[51] Int. Cl.[2] ..... D21F 9/00

[52] U.S. Cl. ..... 162/290; 162/301; 162/305; 162/306; 162/359; 162/360 R

[58] Field of Search ..... 162/203, 205, 206, 290, 162/300, 301, 305, 306, 317, 350, 359, 360 R

[56] References Cited

U.S. PATENT DOCUMENTS

| | | | |
|---|---|---|---|
| 2,977,277 | 3/1961 | Kelly | 162/203 |
| 3,378,435 | 4/1968 | Loynd | 162/317 X |
| 3,537,954 | 11/1970 | Justus | 162/305 |
| 3,694,311 | 9/1972 | Skeppstedt | 162/290 |
| 3,861,996 | 1/1975 | Dorfel | 162/306 X |
| 3,891,500 | 6/1975 | Kankaanpaa | 162/359 X |
| 3,997,390 | 12/1976 | Kankaanpaa | 162/203 X |

*Primary Examiner*—Richard V. Fisher

*Attorney, Agent, or Firm*—Steinberg & Blake

[57] ABSTRACT

A paper machine wherein a pick-up roll or felt are eliminated. A pair of endless fabrics and forming rolls cooperating therewith provide with the pair of endless fabrics an ascending twin-wire former and in advance of the twin-wire former a single-wire former. One of these endless fabrics has an upper run extending laterally from the twin-wire former and carries the web formed at the twin-wire former beyond the latter on an upper surface of this upper run. A pair of press rolls include lower and upper press rolls which define a first press nip through which the above upper run travels together with an endless felt which is lapped around the upper press roll so that this endless felt and the above upper run are sandwiched between the press rolls with the web travelling beyond the first press nip together with the endless felt around part of the upper press roll. A rotary cylinder defines with this upper press roll at least a second press nip where the above endless felt travels together with the web between the upper press roll and this rotary cylinder. In this way the web is fully supported along a closed conduction path from the twin-wire former through the first and second press nips which form part of a press section to which the web is delivered without requiring a pick-up roll or felt.

11 Claims, 2 Drawing Figures

L
K
W
47
46
45
100
11
10
12
13
14
15
16
17
18
21
22
26
27
28
70

ASCENDING TWIN-WIRE PAPER MACHINE WITHOUT WEB PICK-UP

BACKGROUND OF THE INVENTION

The present invention relates to paper machines.

In particular, the present invention relates to a paper machine suitable for manufacturing tissue paper.

The paper machine includes a forming section where a pair of endless fabrics cooperate to provide an ascending twin-wire former as well as a single-wire former in advance of the twin-wire former, with a headbox supplying pulp suspension onto the single-wire former, suitable forming rolls cooperating with the endless fabrics and providing a web-draining region therewith.

As is well known, tissue paper is commonly manufactured by forming a web on a fairly short wire section resembling a normal planar wire where the headbox supplies the stock onto a breast roll which is often open or provided with an interior vacuum. The web travels beyond the breast roll supported by the wire past conventional dewatering elements such as table roll deflectors, foil laths, suction boxes and a suction roll, each of which removes water from the forming web. At the end of wire section the partly dried web is transferred onto a so-called pick-up felt, and while supported thereby it passes, while being subjected to further drying, to the press and drying sections of the machine. In some machines the planar wire part has been entirely omitted. Instead, web formation takes place, in this case, in its entirety on the suction breast roll which is wire-coated and from which the web is directly transferred to the pick-up felt. The above conventional constructions have a serious drawback, among others, in that the upper speed limit of the paper machine will be on the order of 1500 m/min., because the draining pressure tends to become excessively high with the result that the web will undesirably adhere to the wire.

Several twin-wire formers intended for manufacturing tissue paper also are known in the art. Most of these twin-wire formers are so-called full throat formers, but this type of construction has generally had the drawback that as a result of the full-throat forming there is a poor formation of the web with the web also adhering undesirably to the wire as a result of high draining pressure. These drawbacks result in splitting of the paper. In addition, there is the further drawback of poor retention of fibers and filler substances.

With respect to prior patent literature which may be pertinent, reference may be made, by way of example, to Canadian Pat. No. 968,601, which relates to the same general field as the present invention and which discloses a certain type of pick-up press. Reference also may be made to U.S. Pat. Nos. 3,378,435 and 3,537,954, the first of these patents providing the machine commonly known as the Crescent former. Reference may also be made to the presently pending U.S. patent application Ser. No. 730,444 filed May 20, 1968. Another commonly known former construction is illustrated in British Pat. No. 1,244,040 in which the so-called Papriformer of AB Karlstads Mekaniska Verkstad is shown.

With respect to the construction of the paper machine of the present invention, this machine of the present invention is a further development of the twin-wire former disclosed in U.S. Pat. No. 3,846,232 and in the associated continuation-in-part application Ser. No. 493,704 filed July 31, 1974, now U.S. Pat. No. 3,997,390.

With respect to these structures, reference is particularly directed to the single-wire initial part of the former, with respect to the possibility of regulating the various process variables in a manner to which the practical paper maker is already accustomed in connection with Fourdrinier paper machines. In this connection, most important among these process variables are the discharge velocity of the stock jet with reference to the wire, the contact angle of the stock jet with the wire, and the rate at which water is drained from the suspension conducted onto the wire.

SUMMARY OF THE INVENTION

It is among the objects of the present invention to bring about improvements in the previously known paper machines, particularly in machines for manufacturing tissue paper, by creating a totally new concept of the paper machine and of the press and drying sections associated therewith.

In particular, it is an object of the present invention to provide a paper machine wherein the pick-up means is eliminated. In connection with exceedingly thin types of paper, such as tissue paper, it is the pick-up section where a particular bottleneck occurs in conventional machines with the greatest risk of breaking of the web occurring at the location where the web is picked up from the forming wire, at the region of the couch roll, to travel beyond the forming wire to the press section. Particularly if an attempt is made to increase the operating speed of the machine, one encounters such problems at the pick-up region of conventional machines.

A further object of the present invention is to provide a paper machine former with a symmetrical dewatering action as well as dewatering and subsequent pressing which are capable of preserving the softness and resiliency required in a paper such as tissue paper.

A further object of the present invention is to improve the capability of retaining fibers and filler substances as well as to achieve the best possible resistance to splitting.

A still further object of the present invention is to improve the sound insulation of a paper machine.

According to the invention the web is formed in part in a twin-wire former and is transferred from the latter on the upper surface of an upper run of one of the endless fabrics which forms part of the twin-wire former, the web being carried in this way in closed conduction from the twin-wire former to the first press nip of the press section of the machine. The first press nip is defined by a pair of press rolls in such a way that at this first nip the web is sandwiched between the above upper run of one of the fabrics of the twin-wire former and a felt which forms part of the press section, the web being detached from the upper run of the above endless fabric of the twin-wire former to travel with this felt in closed conduction to a second press nip defined between the upper one of the above pair of press rolls, which define the first press nip, and a rotary cylinder which is in the form of a preferably smooth roll, such as a Yankee cylinder or the smooth central roll of the press section.

Thus, according to the invention the paper machine includes a pair of endless fabric means and a forming roll means cooperating therewith for providing with the pair of endless fabric means an ascending twin-wire former and in advance of the twin-wire former a single-wire former. One of these endless fabric means has an upper run extending laterally from the twin-wire former and carrying the web formed at the twin-wire former beyond the latter on an upper surface of this upper run of this one fabric means. A pair of press rolls include a lower press roll and an upper press roll for defining between themselves a first press nip, the above upper run passing between these press rolls together with an endless felt which is lapped around the upper press roll so that the endless felt and the above one fabric means are sandwiched between the press rolls. The web travels beyond the first press nip together with the endless felt around part of the upper press roll. A rotary cylinder defines with this upper press roll at least a second press nip where the endless felt travels together with the web between the upper press roll and this rotary cylinder. In this way the web is fully supported along a closed conduction path through the press section without requiring a pick-up roll or felt.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
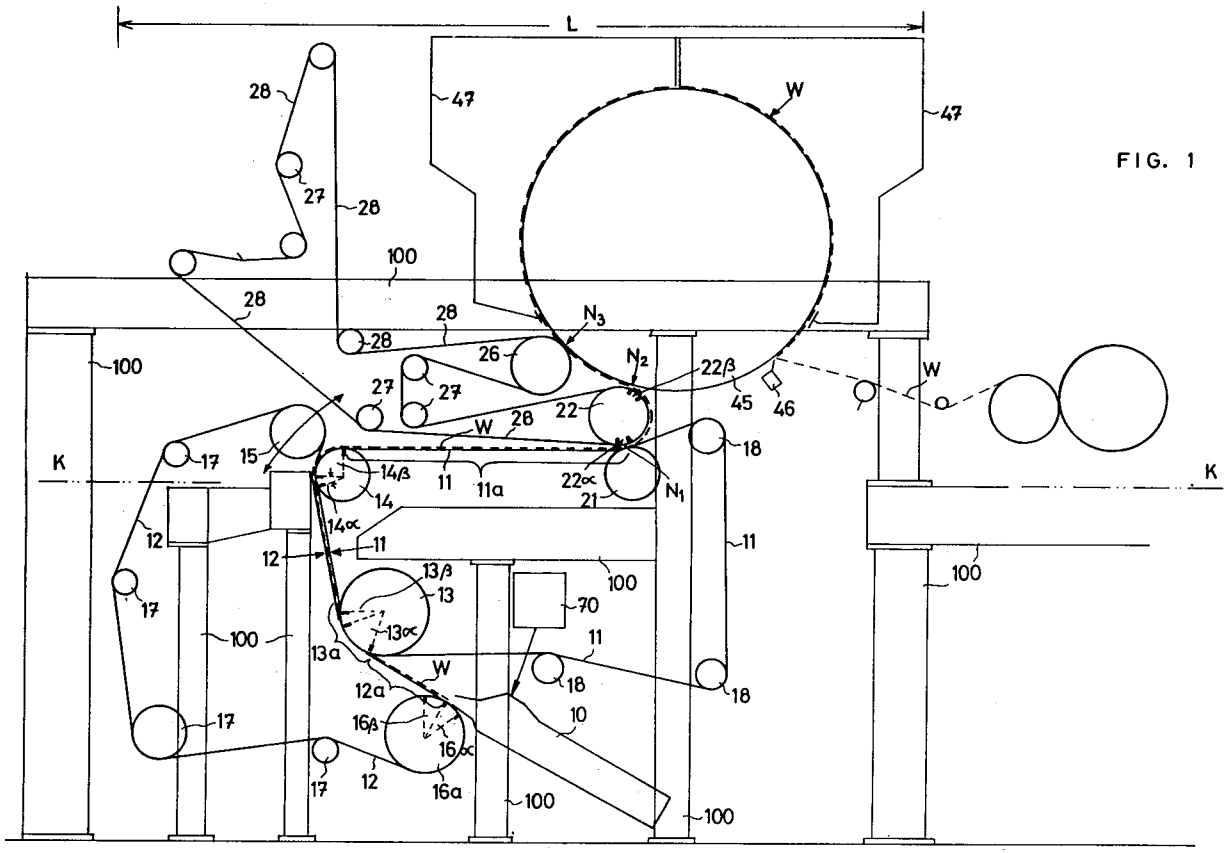
FIG. 1 is a schematic elevation of one embodiment of a paper machine according to the invention.
Figure 2:
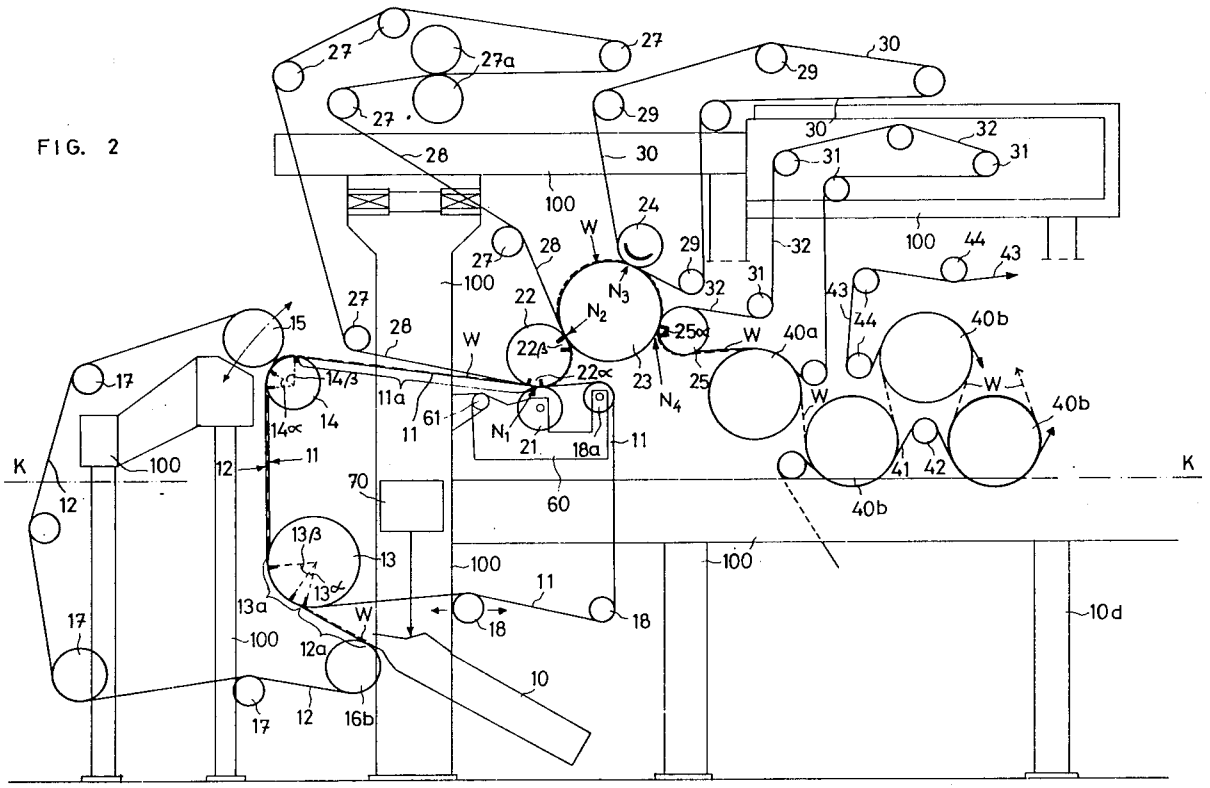
FIG. 2 is a schematic elevation of another embodiment of a paper machine according to the invention.

In FIGS. 1 and 2, equivalent components are indicated by the same references characters. Thus, FIGS. 1 and 2 schematically illustrate the frame 100 which carries the various components of the paper machine. In both embodiments the paper machine includes a hydraulic headbox 10, shown at the lower central parts of FIGS. 1 and 2, and serving to supply stock suspension to the initial part of the draining region at the former of the paper machine. The former includes a pair of endless fabric means 11 and 12, each of which may be in the form of a suitable endless wire or felt. The endless fabric means 12 is guided by a plurality of guide rolls 17. In FIG. 1 the endless fabric means 12 travels around the breast roll **16*a*, while in FIG. 2 the endless fabric means 12 travels around the breast roll 16*b*. In both embodiments the endless fabric means 12 travels at its highest part around a return roll 15**.

The endless fabric means 11 of the former travels along a substantially rectangular path around a pair of forming rolls 13 and 14 and between a pair of press rolls 21 and 22 while being guided by a guide means which includes the guide rolls 18.

Between the pair of forming rolls 13 and 14, the pair of endless fabric means 11 and 12 have a common run forming an ascending twin-wire former extending upwardly from the roll 13 to the roll 14 which forms the couch roll around which the endless fabric means 11 travels to the first nip $N_1$ defined between the press rolls 21 and 22. In this way the endless fabric means 11 is provided with the upper lateral run **11*a* shown in FIGS. 1 and 2. The web W indicated by way of a dotted line thus travels between the pair of endless fabric means 11 and 12** at the parts thereof which form the twin-wire former, and at this part of the machine there may be additional rolls and various dewatering components.

As is indicated in FIGS. 1 and 2, the forming roll 13 includes a suction means formed by a pair of consecutive suction zones 13 $\alpha$ and 13 $\beta$. Instead of the suction roll 13 it is also possible to use a smooth roll or a roll having a recessed surface without suction. As is shown in FIGS. 1 and 2, the couch roll 14 of the forming roll means has a pair of suction zones 14 $\alpha$ and 14 $\beta$, these suction zones forming a suction means where the web W becomes detached from the endless fabric means 12 to continue to travel with the endless fabric means 11, supported on the upper surface of the upper run **11*a* thereof. The position of the return roll 15 is preferably adjustable, as indicated by the curved double-headed arrow extending through the return roll 15, so that by suitable adjustment of the position of the roll 15 it is possible to adjust the point where the web W becomes detached from the endless fabric means 12**.

Between the roll **16*a* of FIG. 1 or the roll 16*b* of FIG. 2 and the roll 13 shown in both embodiments, the endless fabric means 12 has a portion 12*a* which forms a single-wire former situated in advance of the twin-wire former. Dewatering of the web starts before the twin-wire former on this single-wire former 12*a*. This single-wire former 12*a* constitutes an important draining region where the major part of the water (for example about 50%) has time to escape through the wire portion 12*a* primarily as a result of gravity. At this single-wire run 12*a*** it is possible to enhance the dewatering by utilizing suitable foils, dewatering boxes, and other equivalent components. However, the use of abrasive components is not advantageous due to the rapid wear thereof and due to their abrasive effect on the wire.

After initial formation of the web W at the single-wire former **12*a*, continued web formation takes place along the curved part 13*a* of the forming roll 13 where the pair of endless fabric means 11 and 12 come together to form the initial part of the twin-wire former. At this part 13*a* the forming roll 13 has a suction means formed by the suction zones 13 $\alpha$ and 13 $\beta$. At this curved run 13*a*, dewatering takes place simultaneously in a pair of opposed directions, through the endless fabric means 12 as a result of centrifugal force and toward the forming roll 13 as a result of the vacuum in the suction zones 13 $\alpha$, 13 $\beta$. This two-sided dewatering contributes to the symmetrical dewatering action. By suitably selecting the mutual proportions and magnitudes of the vacuums prevailing in the suction zones 13 $\alpha$ and $\beta$ of the forming roll 13**, it is possible to achieve the result of distributing the dewatering suitably along the length of the twin-wire former.

The couch roll 14 is situated in both embodiments in the loop formed by the endless fabric means 11 and has also a suction means formed by the suction zones 14 $\alpha$ and 14 $\beta$. The first suction zone 14 $\alpha$ preferably is operated at a greater vacuum than the second suction zone 14 $\beta$. By way of the first suction zone 14 $\alpha$, the web W which has travelled between the endless fabric means 11 and 12 at the twin-wire former is partly detached from the endless fabric means 12, becoming separated from the mesh thereof and adhering reliably to the endless fabric means 11, so that in this way the web W is safely detached from the endless fabric means 12 at the region of the second suction zone 14 $\beta$, to be transferred in this way from the twin-wire former while adhering to the upper surface of the endless fabric means 11 at the upper run **11*a* thereof. This upper run 11*a* extends laterally from the twin-wire former in a substantially horizontal direction, and the web W is thus transferred in closed conduction, without any intermediate steps or pick-up means being required, to the first press nip $N_1$, where the web W becomes detached from the endless fabric means 11**. This transfer of the web without any intermediate steps directly to the first press nip of the press section of the machine is one of the primary features of the present invention.

The lower press roll 21 at the first press nip $N_1$ of the press section is an efficiently dewatering roll, such as a roll having a suitably recessed surface (a grooved roll, a roll provided with drilled holes extending into the roll from its exterior surface and having closed inner ends, a wire-coated roll, etc.). The upper press roll 22 at the first press nip $N_1$ includes a suction means formed by the suction zone 22 $\alpha$, so that dewatering at this first press nip is substantially symmetrical in both directions.

At the first press nip $N_1$ the web travels while being sandwiched between the endless fabric means 11 and an endless felt 28 which forms part of the press section. Thus, it will be seen that the endless felt 28 laps around the upper press roll 22. This endless felt 28 is guided by a plurality of guide rolls 27. Thus, as pointed out above, at the first press nip $N_1$ dewatering is symmetrical in both directions, and the first suction zone 22 $\alpha$ of the upper press roll 22 assures that the web W is reliably detached from the endless fabric means 11, the web W thus travelling together with the felt 28 in closed conduction to the second press nip $N_2$. At this second press nip $N_2$, the upper press roll 22 has a second suction zone 22 $\beta$.

It is at this second test nip $N_2$ that the embodiments of FIGS. 1 and 2 differ from each other in an important way. Thus, with the embodiment of FIG. 1, the second press nip $N_2$ is defined between the upper press roll 22 and a Yankee cylinder 45 which forms part of the drying section of the machine in a well known manner. In connection with this Yankee cylinder 45 there is a third press nip $N_3$ defined between the Yankee cylinder 45 and an additional press roll 26. It will be noted from FIG. 1 that the endless felt 28 also passes through this third press nip $N_3$, in much the same way that the endless felt 28 travels through the first and second press nips. If desired, however, the press nip 26 may be provided with its own felt. In some cases the third press nip $N_3$ is not required.

In connection with the embodiment of FIG. 1, a suitable hood 47 cooperates with the Yankee cylinder 45. The dry web is detached from the Yankee cylinder 45 by way of a suitable creping doctor 46 by way of which creping takes place in a well known manner. The web W travels beyond the creping doctor 46 in a well known manner to suitable calendar rolls and then to suitable reels.

As is indicated in FIG. 1, at the beginning of the single-wire draining region 12*a* there is positioned immediately subsequent to the headbox 10 a suction breast roll 16*a* having the suction zones 16 $\alpha$ and 16 $\beta$, these suction zones being operated with a magnitude and mutual proportion of the vacuum which can be utilized to exert a considerable influence on the dewatering at this critical initial stage of web formation. However, instead of the suction breast roll 16*a* it is possible to use a smooth roll 16*b,* as indicated in FIG. 2.

FIGS. 1 and 2 schematically illustrate a control means 70. This control equipment is operatively connected to the headbox 10 at the upper lip of the slice thereof for adjusting this upper lip so as to control the size and direction of the slice with respect to the plane of the draining region 12*a.* By way of this adjustment a number of different factors can be influenced in a way which is important from the viewpoint of paper manufacturing. In this connection reference may be made to U.S. patent application Ser. No. 493,704 filed July 31, 1974, now U.S. Pat. No. 3,997,390.

The embodiment of FIG. 2 differs from that of FIG. 1 in connection with the structure at the region of the lower press roll 21. In FIG. 2 the lower press roll 21 of the first press nip $N_1$ of the press section is carried by beams 60 which are carried by suitable pivot means 61 so as to be turnable about a horizontal axis defined by the pivot means 61. Thus, by adjusting the angular position of the beams 60 it is possible to control the pressure between the press rolls 21 and 22, and in this way it is possible to transform the press section from an operating condition where it is suitable for making wet crepe to a condition suitable for producing dry crepe, by appropriately reducing the line pressure between the press rolls 21 and 22.

Furthermore, it will be noted that the embodiment of FIG. 2 differs from that of FIG. 1 in that the guide roll 18*a* of FIG. 2, corresponding to the upper right guide roll 18 of FIG. 1, is in FIG. 2 also supported for rotary movement by the beams 60. In this connection it is to be noted that in both embodiments the upper right roll 18 of FIG. 1 and the guide roll 18*a* of FIG. 2 are positioned so as to guide the upper run 11*a* of the endless fabric means 11, as it travels beyond the press nip $N_1$, in a direction which is inclined at least slightly upwardly from the press nip $N_1$ so that the upper run of the endless fabric means 11 is slightly, at least, lapped around the upper press roll 22.

The embodiment of FIG. 2 also differs in an important way from FIG. 1 in that instead of utilizing a Yankee cylinder type of dryer, a multicylinder dryer section is utilized. In advance of this multicylinder dryer section, the embodiment of FIG. 2 has a closed press section which includes a rotary cylinder formed by a smooth central press roll 23 which in the embodiment of FIG. 2 cooperates with the upper press roll 22 in order to form the second press nip $N_2$, this central smooth press roll 23 also cooperating with further press rolls 24 and 25 to define the third press nip $N_3$ and fourth press nip $N_4$, respectively, as illustrated in FIG. 2. This smooth central press roll 23 is, for example, a stone roll. The press rolls 24 and 25 which respectively define the nips $N_3$ and $N_4$ are respectively provided with their own felts 30 and 32. The endless felt 30 is guided by the guide rolls 29, while the endless felt 32 is guided by the guide rolls 31. In both embodiments the endless felt 28 is guided by guide rolls 27. It will be noted, however, that in FIG. 2 a pair of press rolls 27*a* are provided for conditioning the felt 28 utilized for the press nips $N_1$ and $N_2$ in the embodiment of FIG. 2.

In this embodiment of FIG. 2, the paper web W travels together with the felt 32 from the last press roll 25 to the first drying cylinder 40*a* of the multicylinder dryer section. In this connection the last press roll 25 has a suction means formed by the suction zone 25 $\alpha$ to detach the web W from the central press roll 23 in order to continue the travel of the web to the dryer section. In a manner which is per se well known the multicylinder dryer section includes a number of drying cylinders 40*b* arranged in two rows with the drying cylinders of the upper row being situated in alignment with the spaces between the drying cylinders of the lower row. However, as is shown in FIG. 2, the first drying cylinder 40*a* of the upper row is situated at a somewhat lower elevation than the other drying cylinders of the upper row so that the first free draw of the web W, as the web W travels beyond the drying cylinder 40*a,* is relatively short in the drying section. The multicylinder dryer section includes felts 41 and 43 respectively guided by guide rolls 42 and 44 in the manner shown fragmentarily and schematically in FIG. 2.

Inasmuch as the paper machine of the invention does not make use of a so-called throat former, the dewatering at the range of the single-wire draining region 12*a*, takes place through the wire 12 primarily by gravity and in any event in a cautious, gradual manner, as contrasted, for example, with the case where the web is immediately subjected to a relatively high degree of compression between a pair of wires. In addition, this draining region 12*a* can be made of sufficient length according to the structure of the invention. However, perhaps the most important advance achieved by way of the present invention is the elimination of a pick-up means while at the same time effecting a fully closed conduction of the web from the former to the press section and even beyond the latter. In other words it will be noted that with the structure of the invention in FIG. 1 the web W is continuously supported without interruption all the way from the jet which issues from the headbox 10 to the creping doctor 46. With the embodiment of FIG. 2, the web is fully supported all the way from the headbox 10 through the press section with the first completely free draw of the web taking place only beyond the first drying cylinder 40*a*. In this way it is possible to increase the reliability of the operation of the paper machine and reduce the risk of web breakage. Furthermore, with the structure of the invention a symmetrical dewatering action is achieved, so that the paper has a greater splitting strength and a better retention of fibers and filler substances.

According to a further feature of the invention, the machine level of the paper machine is schematically indicated by the line K—K in FIGS. 1 and 2. This line K—K represents the floor of the hall in which the paper machine operations take place. Thus, it will be noted that the headbox 10 as well as the initial single-wire former 12*a* and the lower part of the twin-wire former are situated in the basement of the machine hall, with the twin-wire former extending upwardly through the floor situated at the elevation K—K. Thus, the headbox and part of the suction boxes, which are among the greatest sources of noise resulting from operation of the paper machine, are situated in the basement, thus providing an exceedingly favorable arrangement with respect to insulation of sound.

In addition, with the construction of the invention a totally new machine concept is provided according to which a highly compact structure of the machine is achieved, this compact structure requiring less floor space in the machine hall than has heretofore been required. The total horizontal dimension L of the former and drying section of the paper machine of the invention, this dimension being indicated in FIG. 1, can be made exceedingly small, while the free vertical space in the machine hall can be advantageously utilized inasmuch as there are in any event other reasons requiring a relatively large minimum height in the paper machine.

The present invention is of course not to be considered as being narrowly confined to the embodiments presented above merely by way of example. Various details can of course vary, even to a great extent, while still remaining within the scope of the inventive concept as set forth in the claims which follow.

What is claimed is:

1. In a paper machine, a pair of endless fabric means and forming roll means cooperating therewith for providing with said pair of endless fabric means an ascending twin-wire former and in advance of said twin-wire former a single-wire former, one of said endless fabric means having an upper run extending laterally from said twin-wire former and carrying the web formed at said twin-wire former beyond the latter on an upper surface of said upper run of said one fabric means, a pair of press rolls including a lower press roll and an upper press roll for defining between themselves a first press nip, said upper run of said one fabric means passing between said press rolls and an endless felt also passing between said press rolls and being lapped around said upper press roll so that said endless felt and said one fabric means are sandwiched between said press rolls and the web travelling beyond said first nip together with said endless felt around part of said upper press roll, and a rotary cylinder defining with said upper press roll at least a second press nip where said endless felt travels together with the web between said upper press roll and said rotary cylinder, whereby the web is fully supported along a closed conduction path from said twin-wire former through said first and second press nips, the latter forming part of a press section to which the web is delivered without requiring a pick-up roll or felt, said forming roll means including an upper couch roll lapped in part by said one endless fabric means and from which said upper run of said one endless fabric means extends laterally from said twin-wire former, said couch roll including a suction means for detaching the web from the other of said pair of endless fabric means and causing the web to travel with said one endless fabric means beyond said twin-wire former at the upper surface of said upper run of said one endless fabric means, and said forming roll means also including a lower forming roll, said pair of endless fabric means travelling together from said lower forming roll to said upper couch roll while pressing against the web situated between said pair of endless fabric means while they travel upwardly from said lower forming roll to said upper couch roll, so as to form said ascending twin-wire former.

2. The combination of claim 1 and wherein said rotary cylinder is a Yankee cylinder.

3. The combination of claim 2 and wherein said lower press roll is a dewatering roll while said upper press roll includes a suction means for detaching the web from said upper run of said one endless fabric means and causing the web to travel with said endless felt around part of said upper press roll to said second press nip, said Yankee cylinder forming part of a drying section of the machine.

4. The combination of claim 3 and wherein a third press roll is situated next to said Yankee cylinder for defining therewith a third press nip.

5. The combination of claim 4 and wherein said endless felt extends from said second press nip through said third press nip so that the web is sandwiched between said endless felt and said Yankee cylinder when travelling from said second press nip to said third press nip along said Yankee cylinder.

6. The combination of claim 1 and wherein said rotary cylinder is a third press roll of said press section.

7. The combination of claim 6 and wherein said third press roll is a smooth-surfaced central press roll of said press section, and a fourth press roll forming a part of said press section and cooperating with said central roll for defining therewith a third press nip.

8. The combination of claim 7 and wherein a fifth press roll cooperates with said central roll for defining therewith a fourth press nip.

9. The combination of claim 8 and wherein said fifth press roll includes a suction means for detaching the web from said central roll and directing the web along a path of travel to a drying section of the paper machine.

10. The combination of claim 1 and including a floor through which said ascending twin-wire former extends, said single-wire former being situated beneath said floor while said upper run of said one endless fabric means is situated above said floor.

11. The combination of claim 1 and wherein a guide roll means guides said one endless fabric means, said guide roll means including a guide roll situated adjacent but beyond said first press nip and toward which said upper run of said one endless fabric means travels when moving beyond said first press nip, the latter guide roll being situated at an elevation higher than said first press nip so that said upper run of said one endless fabric means is partially lapped around said upper press roll.

* * * * *